United States Patent [19]

Andersson

[11] 4,118,935

[45] Oct. 10, 1978

[54] REGULATION SYSTEM FOR A STEAM TURBINE INSTALLATION

[75] Inventor: Göran Andersson, Lund, Sweden

[73] Assignee: BBC Aktiengesellschaft Brown, Boveri & Cie, Baden, Switzerland

[21] Appl. No.: 749,095

[22] Filed: Dec. 9, 1976

[30] Foreign Application Priority Data

Dec. 19, 1975 [SE] Sweden ..... 7514421

[51] Int. Cl.[2] ..... F01K 7/06

[52] U.S. Cl. ..... 60/662; 60/652; 60/677; 290/40 R; 415/36; 415/39

[58] Field of Search ..... 60/646, 652, 657, 660, 60/661, 662, 677; 415/30, 36, 39; 290/40 R, 40 A, 40 B, 40 C, 40 F

[56] References Cited

U.S. PATENT DOCUMENTS

| | | | |
|---|---|---|---|
| 2,197,651 | 5/1940 | Rosch | 60/660 X |
| 3,055,181 | 9/1962 | Argersinger et al. | 60/652 |

*Primary Examiner*—Allen M. Ostrager

*Assistant Examiner*—Stephen F. Husar

*Attorney, Agent, or Firm*—Werner W. Kleeman

[57] ABSTRACT

A regulation system for a steam turbine installation comprising a steam generator and a multi-stage turbine installation incorporating a high-pressure stage. The regulation system comprises a regulation valve arranged between the steam generator and the high-pressure stage of the turbine installation and a by-pass valve connected in parallel with said high-pressure stage, as well as control devices with associated control circuits for said valves. The control device for the by-pass valve is influenced by the signal from the control circuit of the regulation valve such that when the opening of the regulation valve exceeds a predetermined magnitude the control device for the by-pass valve opens such by-pass valve to a predetermined magnitude. Further, the control circuit of the by-pass valve is connected in parallel with a differentiation element which influences the degree of opening of the by-pass valve as a function of variations in the signal received from the control circuit of the regulation valve.

6 Claims, 1 Drawing Figure

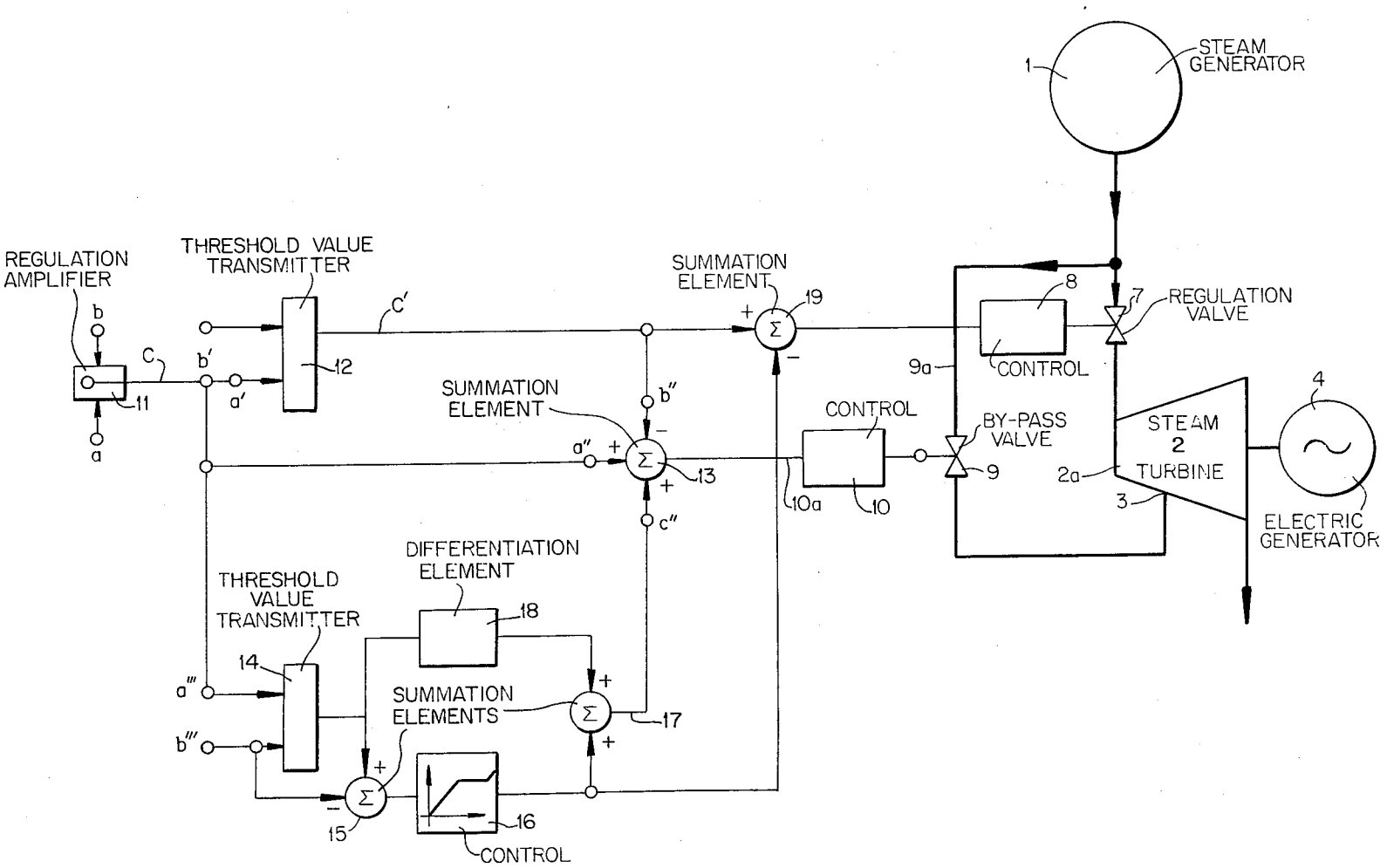
STEAM GENERATOR
1
REGULATION VALVE
7
8
CONTROL
STEAM TURBINE
2
2a
3
4
ELECTRIC GENERATOR
BY-PASS VALVE
9
9a
CONTROL
10
10a
SUMMATION ELEMENT
19
SUMMATION ELEMENT
13
b''
c''
a''
17
DIFFERENTIATION ELEMENT
18
SUMMATION ELEMENTS
16
CONTROL
15
THRESHOLD VALUE TRANSMITTER
12
c'
a'
b'
THRESHOLD VALUE TRANSMITTER
14
a'''
b'''
REGULATION AMPLIFIER
11
b
a
c

REGULATION SYSTEM FOR A STEAM TURBINE INSTALLATION

BACKGROUND OF THE INVENTION

The present invention relates to a new and improved construction of a regulation system for a steam turbine installation which is of the type comprising a steam generator and a multi-stage turbine installation or turbine including a high-pressure stage, and wherein the regulation system comprises a regulation valve arranged between the steam generator and the high-pressure stage of the turbine and a by-pass valve connected in parallel with said high-pressure stage, there also being provided control devices with associated control circuits for such valves.

In systems of the aforementioned general arrangement the by-pass valve is primarily provided for the purpose of admitting additional steam to the intermediate- and low- pressure stages in the presence of an overload and at the operating range around full load.

To obtain good efficiency for the regulation valve the dimensions thereof must be properly accommodated to those of the turbine installation, in order that the regulation valve, during full load, exhibits a small throttling action and thus only has small throttling losses. Yet, due to these measures there is however present at the full load range poor regulation characteristics, i.e. slow regulation, due to the flat regulation characteristics of the regulation valve with low throttling.

SUMMARY OF THE INVENTION

Hence, it is a primary object of the present invention to provide an improved regulation system for a steam turbine installation which is not associated with the aforementioned drawbacks and limitations of the prior art proposals.

Another and more specific object of the present invention aims at the provision of a regulation system for a steam turbine installation which has improved regulation characteristics, and, specifically, wherein the by-pass valve at higher loads is caused to open somewhat in order to prepare the same for rapid changes in the control.

Now in order to implement these and still further objects of the invention, which will become more readily apparent as the description proceeds, the regulation system of the present invention is manifested by the features that the control device for the by-pass valve is influenced by the signal from the control circuit of the regulation valve in such a manner that when opening of the regulation valve has exceeded a predetermined degree, the control device for the by-pass valve opens such by-pass valve to a certain predetermined degree. Further, the control circuit for the by-pass valve is connected in parallel with a differentiation element which influences the degree of opening of the by-pass valve as a function of variations in the signal obtained from the control circuit of the regulation valve. The changed signal to the regulation valve remains, so that the regulation valve can be adjusted in a normal rhythm to the desired steam flow.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically illustrates a steam turbine installation equipped with a regulation system according to the invention.

DETAILED DESCRIPTION OF THE PREFERRED EMBODIMENTS

Describing now the drawing, the exemplary embodiment of steam turbine installation will be seen to comprise a steam generator 1, for instance a steam boiler or nuclear reactor by way of example, and a steam turbine 2 containing a high-pressure stage, generally indicated by reference character 2*a*. The turbine 2 drives a load, such as an electrical generator 4. Between the steam generator 1 and the steam turbine 2 there is arranged a regulation valve 7 and its associated control, for instance a servomotor 8. Connected in parallel with the regulation valve 7 as well as with part of the steam turbine 2 located behind the regulation valve 7 is a by-pass conduit or line 9*a* equipped with a by-pass valve 9 which, for greater loads, delivers steam to an infeed location or opening 3 at the steam turbine 2 where the pressure is lower than directly behind the regulation valve 7. Consequently, the capacity of the turbine 2 is increased. The by-pass valve 9 is also provided with a control, for instance a servomotor 10.

The normal control circuit for the regulation valve 7 and the by-pass valve 9 consists of the components 11, 12 and 13. In the exemplary embodiment under discussion, component 11 is a regulation amplifier, at the inputs *a* and *b* of which there appear the actual value and set or reference value for the magnitudes or parameter to be regulated, for instance the turbine output. The output signal of the regulation amplifier 11 is delivered from its output *c* to the input *a'* of a threshold value transmitter 12, at the other input *b'* of which there appears a reference signal corresponding to full opening of the regulation valve 7. The signal from the threshold value transmitter 12 is delivered to the servomotor 8 for the regulation valve 7.

The signal delivered by the regulation amplifier 11 is also delivered to the input *a''* of the summation or addition element 13 connected in circuit with the input 10*a* of the servomotor 10 for the by-pass valve 9. The other input *b''* of the summation element 13 is connected with the output *c'* of the threshold value transmitter 12.

This threshold value transmitter 12 is constructed as a minimum selector which passes the smallest one of the input signals appearing at the inputs *a'* and *b'*. This means that as long as the signal of the regulation amplifier 11 is below the reference value appearing at the input *b'* of the threshold value transmitter 12, the signals at the input *a''* and *b''* of the summation element 13 are the same and mutually cancel one another.

On the other hand, if the signal emanating from the regulation amplifier 11 exceeds the boundary value set at the input *b'* of the threshold value transmitter 12, which means that the signal delivered by the regulation amplifier 11 exceeds a value which can be handled by the regulation valve 7, in other words, the turbine should be driven to the overload region, then the signal appearing at the input *a''* of the summation element 13 also will exceed the limited signal appearing at the input *b''* of such summation element 13. As a result, the differential signal delivered to the servomotor 10 opens the by-pass valve 9, and the infeed 3 has delivered thereto additional steam, so that the turbine can provide the required excess load or overload.

As already mentioned, the rapidity of response of the regulation valve 7 with a large opening, i.e. small throttling, is extremely poor, since large valve movements are needed in order to bring about the desired change in the flow of steam. According to the invention, this is assisted, as described, by virtue of the fact that the by-pass valve 9 is already introduced as part of the regulation process before the full load range, for instance with 90 to 95% opening of the regulation valve 7. This can be accomplished with the aid of the control circuit 14–18.

In such control circuit the component 14 constitutes a threshold value transmitter, at the input *a'''* of which there appears the signal delivered at the output *c* of the regulation amplifier 11. At the input *b'''* of such threshold value transmitter 14 there is applied a threshold value signal, for instance corresponding to 90 to 95% opening of the regulation valve 7, so that the signal from the regulation amplifier 11 is passed by the threshold value transmitter 14 when it exceeds the threshold value signal appearing at the input *b'''* of such threshold value transmitter 14. Both of the signals are compared in the summation or addition element 15, and the differential signal is delivered to control device 16. Whenever the signal delivered by the regulation amplifier 11 exceeds the boundary value of the signal appearing at the input *b'''* of the threshold value transmitter 14, then the control device 16 delivers a constant signal by means of the summation elements 17 and 13 to the servomotor 10 for the by-pass valve 9, which is then adjusted to a certain opening. The by-pass valve 9 is thus prepared to carry out an upwards as well as downwards regulation when the regulation signal delivered by the regulation amplifier 11 approaches the full load value. The signal delivered by the control device 16 provides a corresponding setting of the size or degree of opening of the by-pass valve 9, so that there is realized a rapid and good regulation response. The signal delivered by the control device 16 is supplied to the summation element 19 for subtraction from the signal delivered to the regulation valve 7, in order to thereby insure for a continuous control.

Connected in parallel with the summation element 15 and the control device 16 is a differentiation element 18 to which there is supplied the signal delivered from the threshold value transmitter 14. Therefore, if the signal delivered by the regulation amplifier 11 exceeds the threshold value of the signal set at the input *b'''* of the threshold value transmitter 14, then the signal delivered by the regulation amplifier 11 is also infed to the differentiation element 18 which therefore, during rapid load changes, alters the setting of the by-pass valve 9 by means of the summation elements 17 and 13 and the servomotor 10. Since, as mentioned the adjusted degree of opening of the by-pass valve 9 in this case thus provides rapid regulation response, there is obtained the desired rapid regulation response for the entire installation.

The signal from the differentiation element 18 progressively decays. If, however, the signal from the regulation amplifier 11 drops below the full load signal set at the input *b'* of the threshold value transmitter 12, then, the signal change coming from the regulation amplifier 11 also influences the servomotor 8, which thus progressively corrects the adjustment of the regulation valve 7. On the other hand, if the signal delivered by the regulation amplifier 11 exceeds the signal appearing at the input *b'* of the threshold value transmitter 12, then the change is delivered by the regulation amplifier 11 directly to the input *a''* of the summation element 13, so that the by-pass valve can be directly set.

The threshold value transmitter 14 is constructed as a maximum selector which passes the largest of the input signals appearing at the inputs *a'''* and *b'''*. Therefore, if the signal delivered by the regulation amplifier 11 falls below the reference signal appearing at the input *b'''* of the threshold value transmitter 14, then this reference signal is passed through.

In so doing, the input signals at the summation element 15 are equal to one another, so that a null signal appears at the control device 16. The differentiation element 18 receives only the constant reference signal from the input *b'''* of the threshold value transmitter 14, with the result that the output of the differentiation element 18 and therefore also that of the summation element 17 is equal to null, i.e. the circuit 14 to 18 is then completely non-functional.

While there are shown and described present and preferred embodiments of the invention, it is to be distinctly understood that the invention is not limited thereto, but may be otherwise variously embodied and practiced within the scope of the following claims. Accordingly,

What is claimed is:

1. A regulation system for regulating a predetermined magnitude of a steam turbine installation having a steam generator and a multi-stage turbine including a high-pressure stage having an entrance to said high-pressure stage, said regulation system comprising, in combination:

a regulation valve arranged between the steam generator and the entrance to the high-pressure stage of the turbine;

a by-pass valve arranged between the steam generator and the high-pressure stage in parallel to said regulation valve and connected with a location of the high-pressure stage disposed downstream of said entrance to said high-pressure stage;

a first control circuit including a first control device provided for the regulation valve;

a second control circuit including a second control device provided for the by-pass valve;

said first control circuit for the regulation valve delivering a signal which influences said second control device for said by-pass valve such that when the opening of the regulation valve exceeds a predetermined magnitude said second control device for the by-pass valve opens the by-pass valve to a predetermined magnitude; and a differentiation element connected in parallel with the second control circuit for the by-pass valve for influencing the magnitude of opening of the by-pass valve as a function of variations in the signal received from the first control circuit of the regulation valve.

2. The regulation system as defined in claim 1, wherein said first control circuit further includes:

a regulation amplifier having an input side fed with inputs representative of an actual value and a reference value of the magnitude to be regulated having an output;

a threshold value transmitter connected in circuit with said output of said regulation amplifier and delivering a signal to said first control device of said regulation valve for controlling operation of said regulation valve; and a summation element connected in circuit between said threshold value transmitter and said first control device for controlling said signal delivered to said first control device.

3. The regulation system as defined in claim 2, wherein:

said threshold value transmitter comprises a minimum selector.

4. The regulation system as defined in claim 2, wherein said second control circuit further comprises:

a threshold value transmitter;

said threshold value transmitter having first and second inputs;

said first input of said threshold value transmitter being connected with said output of said regulation amplifier;

control means having an input and an output;

said input of said control means being connected in circuit with said threshold value transmitter;

a summation element connected in circuit with the output of said control means and said second control device for said by-pass valve.

5. The regulation system as defined in claim 4, further including:

a summation element connected in circuit between said second input of said threshold value transmitter of said second control circuit and said input of said control means.

6. The regulation system as defined in claim 4, wherein:

said threshold value transmitter of said second control circuit comprises a maximum selector.

* * * * *